US007009604B2

(12) United States Patent
Chan et al.

(10) Patent No.: US 7,009,604 B2
(45) Date of Patent: Mar. 7, 2006

(54) FRAME DETECTOR FOR USE IN GRAPHICS SYSTEMS

(75) Inventors: William K. Chan, Los Altos, CA (US); Nathaniel David Naegle, Pleasanton, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 345 days.

(21) Appl. No.: 10/199,474

(22) Filed: Jul. 19, 2002

(65) Prior Publication Data

US 2004/0012612 A1 Jan. 22, 2004

(51) Int. Cl.
*G09G 5/00* (2006.01)

(52) U.S. Cl. ..... 345/213; 348/526; 348/542

(58) Field of Classification Search ..... 345/211–213, 345/699; 348/526, 473–479, 525, 542, 558

See application file for complete search history.

(56) References Cited

U.S. PATENT DOCUMENTS

| | | | | |
|---|---|---|---|---|
| 5,249,272 | A * | 9/1993 | Stern | 710/72 |
| 5,608,461 | A | 3/1997 | Sadowski et al. | |
| 5,872,936 | A * | 2/1999 | Eckstein | 710/107 |
| 6,160,589 | A * | 12/2000 | Sadowski | 348/526 |
| 6,424,343 | B1 | 7/2002 | Deering et al. | |
| 6,670,959 | B1 * | 12/2003 | Wasserman et al. | 345/535 |
| 6,700,571 | B1 * | 3/2004 | Nakatani et al. | 345/213 |
| 6,727,957 | B1 * | 4/2004 | Sato | 348/526 |

* cited by examiner

*Primary Examiner*—Alexander Eisen
(74) *Attorney, Agent, or Firm*—Meyertons Hood Kivlin Kowert & Goetzel, P.C.; Jeffrey C. Hood

(57) ABSTRACT

One embodiment of a method of frame detection may involve storing data indicative of a pulse duration and a number of successive occurrences of pulses having that pulse duration for each of several different pulse durations detected within a first field of a composite synchronization signal. This process may be repeated for one or more other fields of the composite synchronization signal. The data stored for each of the fields may be compared, and a frame signal may be generated dependent on an outcome of said comparing.

30 Claims, 7 Drawing Sheets

FRAME DETECTOR FOR USE IN GRAPHICS SYSTEMS

BACKGROUND OF THE INVENTION

1. Field of the Invention

This invention relates generally to the field of computer graphics and, more particularly, to performing frame detection in a graphics system.

2. Description of the Related Art

A computer system typically relies upon its graphics system for producing visual output on the computer screen or display device. Early graphics systems were only responsible for taking what the processor produced as output and displaying it on the screen. In essence, they acted as simple translators or interfaces. Modem graphics systems, however, incorporate graphics processors with a great deal of processing power. They now act more like coprocessors rather than simple translators. This change is due to the recent increase in both the complexity and amount of data being sent to the display device. For example, modern computer displays have many more pixels, greater color depth, and are able to display more complex images with higher refresh rates than earlier models. Similarly, the images displayed are now more complex. Consequently, the generation of these images may involve advanced techniques such as anti-aliasing and texture mapping.

As a result, without considerable processing power in the graphics system, the CPU would spend a great deal of time performing graphics calculations. This could rob the computer system of the processing power needed for performing other tasks associated with program execution and thereby dramatically reduce overall system performance. With a powerful graphics system, however, when the CPU is instructed to draw a box on the screen, the CPU is freed from having to compute the position and color of each pixel. Instead, the CPU may send a request to the video card stating, "draw a box at these coordinates." The graphics system then draws the box, freeing the processor to perform other tasks.

Generally, a graphics system in a computer is a type of video adapter that contains its own processor to boost performance levels. These processors are specialized for computing graphical transformations, so they tend to achieve better results than the general-purpose CPU used by the computer system. In addition, they free up the computer's CPU to execute other commands while the graphics system is handling graphics computations. The popularity of graphics applications, and especially multimedia applications, has made high performance graphics systems a common feature in many new computer systems. Most computer manufacturers now bundle a high performance graphics system with their computing systems.

In many applications, it may be useful to have two monitors or displays connected to the same computer system. For example, in some graphical editing applications, it is desirable to use one monitor to show a close-up of an area being edited, while another monitor shows a wider field of view of the object or picture being edited. Alternatively, some users may configure one monitor to display the object being edited and the other monitor to display various palettes or editing options that can be used while editing. Another situation where multiple displays are useful occurs when several users are connected to a single computer. In such a situation, it may be desirable for users to have their own displays. In another situation, it may simply be desirable to have multiple displays that each display a different portion of an image in order to provide a larger display than would otherwise be possible. Another example is stereo goggles, which present different images to their wearer's left and right eyes in order to create a stereo viewing effect. These examples illustrate just a few of the many situations where it is useful to have multiple displays connected to the same computer system.

In many situations, it may be useful to synchronize multiple display channels. For example, in stereo display (e.g., where left and right images are provided to a user's left and right eyes by a pair of stereo goggles), virtual reality, and video recording, distracting visual effects may occur unless the various display streams are synchronized. For example, if the displays in a stereo display system are not synchronized, the left image and right image may not display left- and right-eye views of the same image at the same time, which may disorientate a viewer.

Each display stream may have its own video timing generator (VTG). While each of the VTGs for the display streams which are to be synchronized may be set to use the same timing, variations in the reference frequencies used by each display stream may eventually cause their respective video timings to drift relative to each other. To solve this problem, methods of synchronizing multiple display channels have been devised which involve setting one display channel as the "master" channel and setting the other display channel(s) to be "slave" channels. The slave channels may be configured to synchronize to the master by jumping to the beginning of a frame whenever they detect the master's next frame beginning.

Often, all or some of the master display channel's synchronization signals (FRAME, VSYNC, and HSYNC) may be combined into a single signal (CSYNC) for transmission to the slave display channels. In order to synchronize to the master display channel, each slave display channel needs to detect the beginning of a frame within the CSYNC signal. However, different master display channels may combine various synchronization signals into a CSYNC signal using a variety of different techniques. For example, the synchronization signals may be combined by performing a logical XNOR operation. Some CSYNC signals may be active-high while others may be active-low. Furthermore, CSYNC signals differ depending on the underlying display format of the master display channel. Because of the variations that may arise between different implementations of CSYNC signals, it is desirable to have a frame detector that is capable of detecting the beginning of a frame within many different CSYNC signals, even if the frame detector has not been preprogrammed to recognize such CSYNC signals.

SUMMARY OF THE INVENTION

In one embodiment, a frame detector may include a measurement unit, a counter, memory, and a control unit. The measurement unit may be configured to generate data indicative of the duration of each pulse included in a composite synchronization signal. The counter may be configured to generate data indicative of a number of successive occurrences of pulses having a same duration. The memory stores pattern data detected during each of a plurality of fields. Each field's pattern data includes data indicative of two or more pulse durations generated by the measurement unit. Each field's pattern data also includes data indicative of two or more counts generated by the counter. Each count is associated with a respective one of the pulse durations. The control unit may be configured to perform a comparison of the pattern data stored during each of the fields and to identify which pattern data identifies the first field in a frame dependent on the comparison. In some embodiments, the control unit may be configured to determine which field's pattern data identifies the first field in a frame in response to a frame signal that is input to the frame detector during a training mode.

One embodiment of a method of frame detection may involve storing data indicative of a pulse duration and a number of successive occurrences of pulses having that pulse duration for each of several different pulse durations detected within a first field of a composite synchronization signal. This process may be repeated for one or more other fields of the composite synchronization signal. The data stored for each of the fields may be compared, and a frame signal may be generated dependent on an outcome of said comparing.

Another embodiment of a method of frame detection may involve comparing patterns detected during each of a plurality of fields within a composite synchronization signal to identify which pattern represents a first field in a frame. Each pattern includes at least two pulse measurements and at least two counts. Each count indicates a number of successive occurrences of pulses having a respective one of the pulse measurements. In response to detecting an occurrence of the pattern representing the first field in the frame within the composite synchronization signal, a frame signal may be toggled. A pattern for one of the fields may be generated by: measuring a new pulse duration of a new pulse detected within the composite synchronization signal; incrementing a count associated with a current pulse duration if the new pulse duration matches the current pulse duration; if the new pulse duration does not match the current pulse duration, storing the current pulse duration and the count as part of the pattern and recording the new pulse duration as the current pulse duration; and repeating said measuring, incrementing and storing for one or more pulses subsequently detected within the composite synchronization signal.

Yet another embodiment of a method may involve storing data indicative of patterns detected during each of a plurality of fields within a composite synchronization signal. Each pattern includes at least two pulse measurements and at least two counts, and each count indicates a number of successive occurrences of pulses having a respective one of the pulse measurements. During training mode, an edge in a frame signal may be detected during one of the fields. In response, the pattern for the field in which the edge in the frame signal is detected may be identified as the pattern that is indicative of a first field in a frame. During a non-training mode, a frame signal generated by a frame detector may be toggled in response to detection of a pattern matching the one pattern identified as indicative of the first field in the frame.

BRIEF DESCRIPTION OF THE DRAWINGS

The foregoing, as well as other objects, features, and advantages of this invention may be more completely understood by reference to the following detailed description when read together with the accompanying drawings in which.

Figure 1:
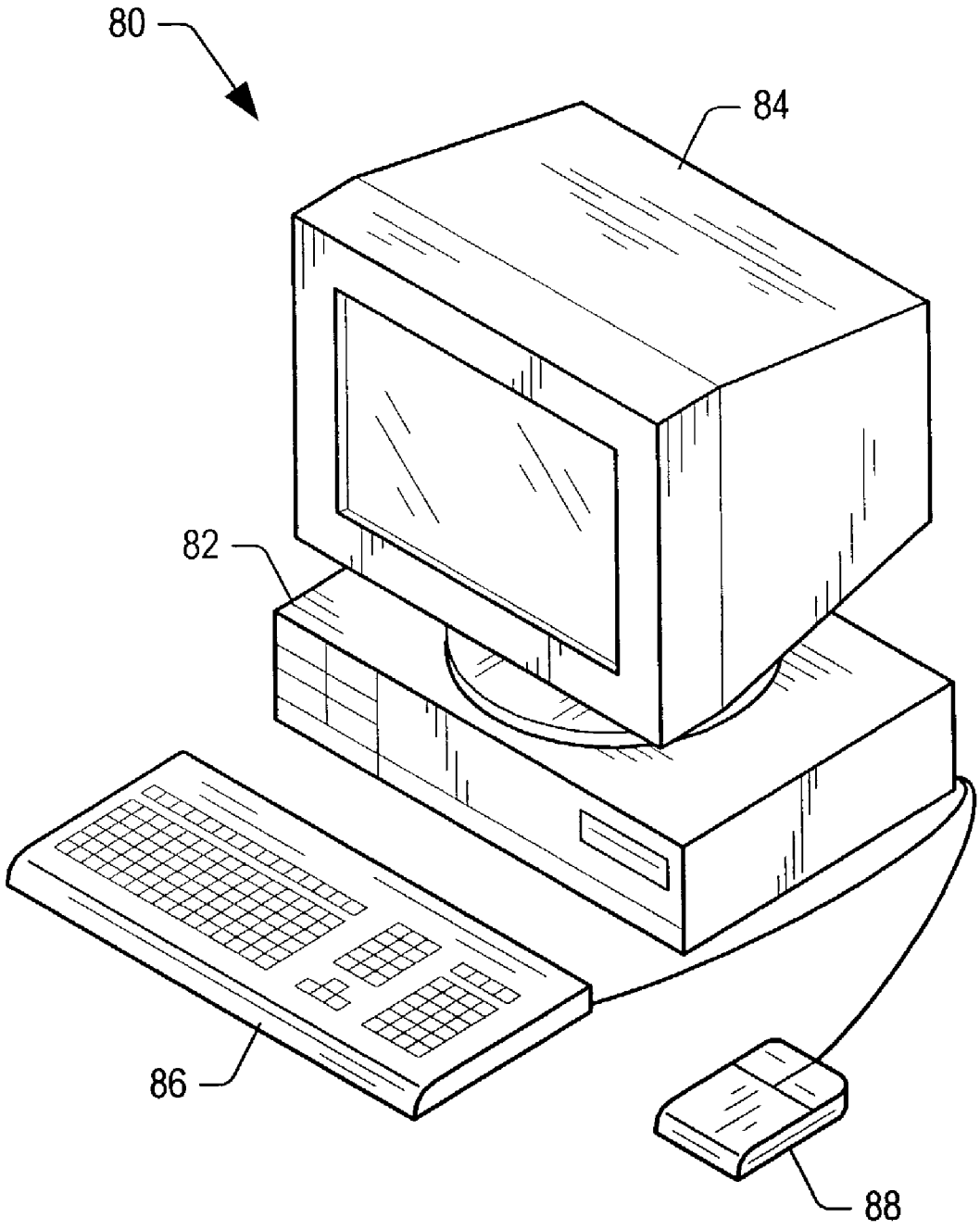
FIG. 1 is a perspective view of one embodiment of a computer system.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must)." The term "include", and derivations thereof, mean "including, but not limited to". The term "connected" means "directly or indirectly connected", and the term "coupled" means "directly or indirectly connected".

DETAILED DESCRIPTION OF EMBODIMENTS

Computer System—FIG. 1

FIG. 1 illustrates one embodiment of a computer system 80 that includes a graphics system. The graphics system may be included in any of various systems such as computer systems, network PCs, Internet appliances, televisions (e.g. HDTV systems and interactive television systems), personal digital assistants (PDAs), virtual reality systems, and other devices that display 2D and/or 3D graphics, among others.

As shown, the computer system 80 includes a system unit 82 and a video monitor or display device 84 coupled to the system unit 82. The display device 84 may be any of various types of display monitors or devices (e.g., a CRT, LCD, or gas-plasma display). Various input devices may be connected to the computer system, including a keyboard 86 and/or a mouse 88, or other input device (e.g., a trackball, digitizer, tablet, six-degree of freedom input device, head tracker, eye tracker, data glove, or body sensors). Application software may be executed by the computer system 80 to display graphical objects on display device 84.

Figure 2:
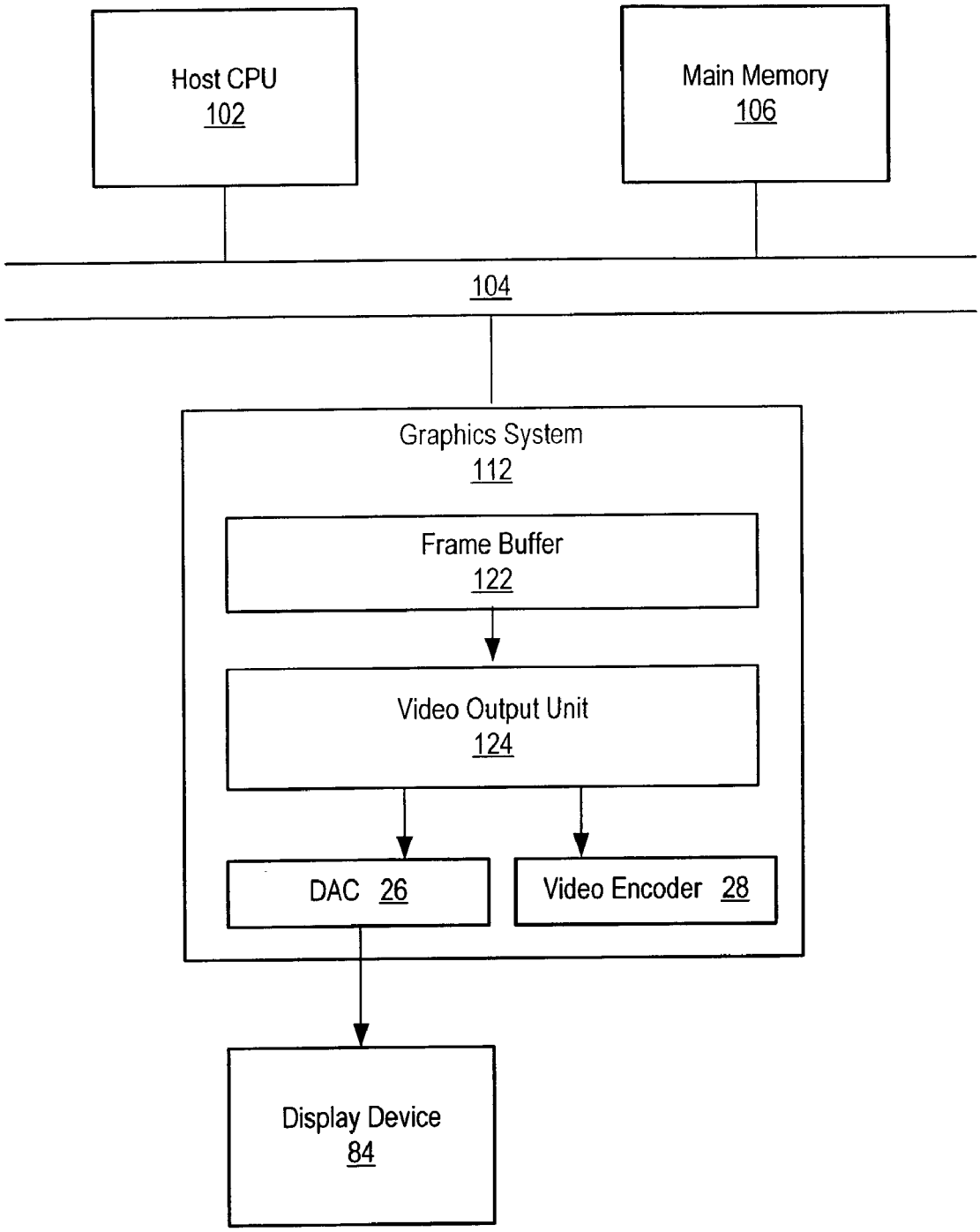
FIG. 2 is a simplified block diagram of one embodiment of a computer system.

Computer System Block Diagram—FIG. 2

FIG. 2 is a simplified block diagram illustrating the computer system of FIG. 1. As shown, the computer system 80 includes a central processing unit (CPU) 102 coupled to a high-speed memory bus or system bus 104 also referred to as the host bus 104. A system memory 106 (also referred to herein as main memory) may also be coupled to high-speed bus 104.

Host processor 102 may include one or more processors of varying types, e.g., microprocessors, multi-processors, and CPUs. The system memory 106 may include any combination of different types of memory subsystems such as random access memories (e.g., static random access memories or "SRAMs," synchronous dynamic random access memories or "SDRAMs," and Rambus dynamic random access memories or "RDRAMs," among others), read-only memories, and mass storage devices. The system bus or host bus 104 may include one or more communication or host computer buses (for communication between host processors, CPUs, and memory subsystems) as well as specialized subsystem buses.

In FIG. 2, a graphics system 112 is coupled to the high-speed memory bus 104. The graphics system 112 may be coupled to the bus 104 by, for example, a crossbar switch or other bus connectivity logic. It is assumed that various other peripheral devices, or other buses, may be connected to the high-speed memory bus 104. It is noted that the graphics system 112 may be coupled to one or more of the buses in computer system 80 and/or may be coupled to various types of buses. In addition, the graphics system 112 may be coupled to a communication port and thereby directly receive graphics data from an external source, e.g., the Internet or a network. As shown in the figure, one or more display devices 84 may be connected to the graphics system 112.

Host CPU 102 may transfer information to and from the graphics system 112 according to a programmed input/output (I/O) protocol over host bus 104. Alternately, graphics system 112 may access system memory 106 according to a direct memory access (DMA) protocol or through intelligent bus mastering.

A graphics application program conforming to an application programming interface (API) such as OpenGL® or Java 3D™ may execute on host CPU 102 and generate commands and graphics data that define geometric primitives such as polygons for output on display device 84. Host processor 102 may transfer the graphics data to system memory 106. Thereafter, the host processor 102 may operate to transfer the graphics data to the graphics system 112 over the host bus 104. In another embodiment, the graphics system 112 may read in geometry data arrays over the host bus 104 using DMA access cycles. In yet another embodiment, the graphics system 112 may be coupled to the system memory 106 through a direct port, such as the Advanced Graphics Port (AGP) promulgated by Intel Corporation.

The graphics system 112 may receive graphics data from any of various sources, including host CPU 102 and/or system memory 106, other memory, or from an external source such as a network (e.g., the Internet), or from a broadcast medium (e.g., television), or from other sources. Graphics system 112 may buffer this graphics data in a frame buffer 122 for subsequent display. In many embodiments, graphics system 112 may include a hardware accelerator (not shown) configured to additionally process graphics data (e.g., received as graphics primitives) before storing the processed graphics data (e.g., as pixels and/or samples) in the frame buffer 122.

Note while graphics system 112 is depicted as part of computer system 80, graphics system 112 may also be configured as a stand-alone device (e.g., with its own built-in display). Graphics system 112 may also be configured as a single chip device or as part of a system-on-a-chip or a multi-chip module. Additionally, in some embodiments, certain of the processing operations performed by elements of the illustrated graphics system 112 may be implemented in software.

A video output unit 124 may also be included within graphics system 112. Video output unit 124 may buffer and/or process pixels output from frame buffer 122 in some embodiments. For example, video output unit 124 may be configured to read bursts of pixels from frame buffer 122. Video output unit 124 may also be configured to perform double buffer selection if the frame buffer 122 is double-buffered. In some embodiments, the video output unit 124 may also be configured to perform processing operations such as those involving overlay and/or transparency, plane group extraction, gamma correction, psuedocolor or color lookup or bypass, and/or cursor generation. Video output unit 124 may also be configured to support more than one video output stream to more than one display using the more than one independent video timing generators (VTGs). For example, one VTG may drive a 1280×1024 CRT while another may drive a NTSC or PAL device with encoded television video.

The video output unit 124 may also include one or more output devices such as digital-to-analog converters (DACs) 26, video encoders 28, flat-panel-display drivers (not shown), and/or video projectors (not shown). A DAC 26 may operate as the final output stage of graphics system 112 in some embodiments. The DAC 26 translates digital pixel data into analog video signals that are then sent to a display device. In one embodiment, DAC 26 may be bypassed or omitted completely in order to output digital pixel data in lieu of analog video signals (e.g., in order to support one or more display devices, such as LCD-type displays or digital micro-mirror displays, that are based on a digital technology).

DAC 26 may be a red-green-blue digital-to-analog converter configured to provide an analog video output to a display device such as a cathode ray tube (CRT) monitor. In one embodiment, DAC 26 may be configured to provide a high resolution RGB analog video output. Similarly, encoder 28 may be configured to supply an encoded video signal to a display. For example, encoder 28 may provide encoded NTSC or PAL video to an S-Video or composite video television monitor or recording device.

In other embodiments, the video output unit 124 may output pixel data to other combinations of displays. For example, by outputting pixel data to two DACs 26 (instead of one DAC 26 and one encoder 28), video output unit 124 may drive two CRTs. Alternately, by using two encoders 28, video output unit 124 may supply appropriate video input to two television monitors. Generally, many different combinations of display devices may be supported by supplying the proper output device and/or converter for that display device.

Synchronization Signals

Figure 3:
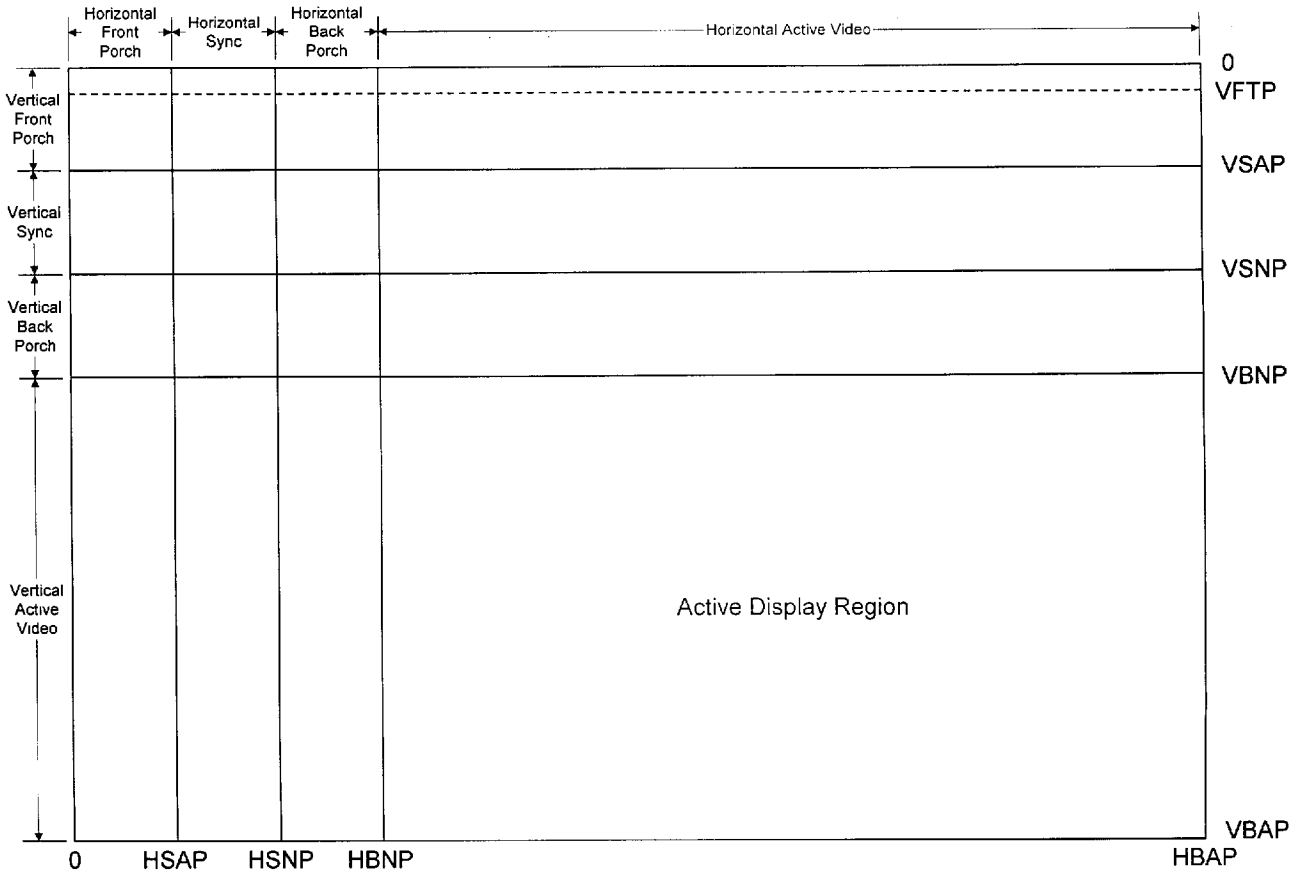
FIG. 3 shows an exemplary video field that may be used in one embodiment.

As mentioned above, a video output unit 124 may include one or more VTGs. Each VTG included in the video output unit 124 is configured to provide one or more synchronization signals (e.g., HSYNC, VSYNC, CSYNC) and/or blanking signals to a display device. FIG. 3 shows one example of the synchronization pulses and blanking signals that may be generated during each field and how these signals correspond to the displayed pixels within that field. Each field includes several lines, and each line may include several pixels. The vertical front porch occurs during the lines between line 0 and VSAP (vertical synchronization assertion point). The vertical synchronization period occurs between the VSAP and the VSNP (vertical synchronization negation point). Thus, the VTG may assert the vertical synchronization signal VSYNC to the display during the vertical synchronization period. Assertion of the VSYNC signal indicates the beginning of a field. The vertical back porch occurs between VSNP and VBNP (vertical blanking negation point). The vertical active display period occurs between VBNP and VBAP (vertical blanking assertion point). The vertical blanking period occurs between VBAP and VBNP.

The horizontal front porch occurs between column 0 and HSAP (horizontal synchronization assertion point. The horizontal synchronization period occurs between the HSAP and HSNP (horizontal synchronization negation point). Thus, the VTG may assert the horizontal synchronization signal HSYNC during the horizontal synchronization period. Assertion of the HSYNC signal indicates the start of a new scan line. The horizontal back porch occurs between the HSNP and NBNP (horizontal blanking negation point). The horizontal active display period takes place between the HBNP and the HBAP (horizontal blanking assertion point). The horizontal blanking period occurs between HBAP and HBNP.

In order to generate the synchronization signals, the VTG may include several control registers that store values representing HSAP, HSNP, VSAP, VSNP, and so on for a given video encoding. The VTG may also include horizontal and vertical counters that are incremented as pixels are provided to the display device (e.g., by incrementing the counters in response to a pixel clock controlling the output rate of the pixel data). These control register values may be compared to the current values of the horizontal and vertical counters and, if they are equal, appropriate signals may be asserted or negated. Note that signals may be either active high or active low.

FIG. 3 also shows a VFTP (vertical frame toggle point) within the field. Each VFTP may occur during the vertical blanking interval of its respective display channel. The VFTP may be a point at which a FRAME signal, which is used to distinguish between successive frames, toggles to indicate that a new frame is beginning. Since the VFTP delineates different frames, the time at which a display channel reaches its VFTP may be referred to as a "frame event." In many embodiments, the VFTP for a display channel occurs between line 0 and VSAP (i.e., during the vertical front porch). When display channels are synchronized to each other, the slave display channels may be configured to jump to their VFTP (as opposed to progressing normally through each successive frame) in response to an indication that the master display channel has reached its VFTP.

The number of fields generated per frame may vary depending on the video format being used. For example, in some embodiments, there may be a single field per frame. In such embodiments, there may be a VFTP within each field. In other embodiments, there may be two or more fields per frame. In some such embodiments, the VFTP may occur in the first and second fields of the frame but not in the remaining fields per frame (e.g., the FRAME signal may be asserted during the first field and deasserted during the remaining fields).

Frame Detector

Graphics system 112 may include one or more VTGs. Each VTG may be used to generate timing signals for a different display stream that flows through graphics system 112. Each VTG may be operable in several modes. In one mode, a VTG may generate its timing signals independently of any other timing signals. In another mode, a VTG may synchronize its timing signals to timing signals generated by another device. The other device may be another VTG (e.g., generating timing signals for another display stream) within the same graphics system 112 or a device external to the graphics system 112. While a VTG may be set to use the same timing as the device to which it is being synchronized, variations in the reference frequencies used by each VTG may eventually cause their respective video timings to drift relative to each other. To solve this problem, methods of synchronizing multiple display streams have been devised which involve setting one display stream as the "master" stream and setting the other display channel(s) to be "slave" streams. In one embodiment, the slave streams may be configured to synchronize to the master stream by having the slave's VTGs jump to the beginning of a frame (e.g., to the vertical blanking interval in the first field in the next frame) whenever they detect the master's next frame (e.g., as indicated by the start of the vertical blanking interval) beginning. Note that in some embodiments, a VTG may be operable in single mode (e.g., slave mode).

The master display channel may be generated by another device (e.g., another graphics card included in another computer system) or by the same device that is generating the slave display channel. All or some of the master display channel's synchronization signals (e.g., FRAME, VSYNC, and HSYNC) may be combined into a single signal (CSYNC) for transmission to the slave display channel(s) in some embodiments. If the master channel's frame signal is not available, a frame detector may be used to detect the VFTP within the master channel's CSYNC (composite synchronization) signal, which may be a combination of several signals (e.g., HSYNC and VSYNC) generated by the master display channel.

The master display channel may combine various synchronization signals into a CSYNC signal using a variety of different techniques. For example, in some embodiments, the synchronization signals may be combined by performing a logical XNOR operation. The CSYNC signal may be an active-high or an active-low signal. Furthermore, CSYNC signals differ depending on the underlying encoding of the master display channel.

Figure 4:
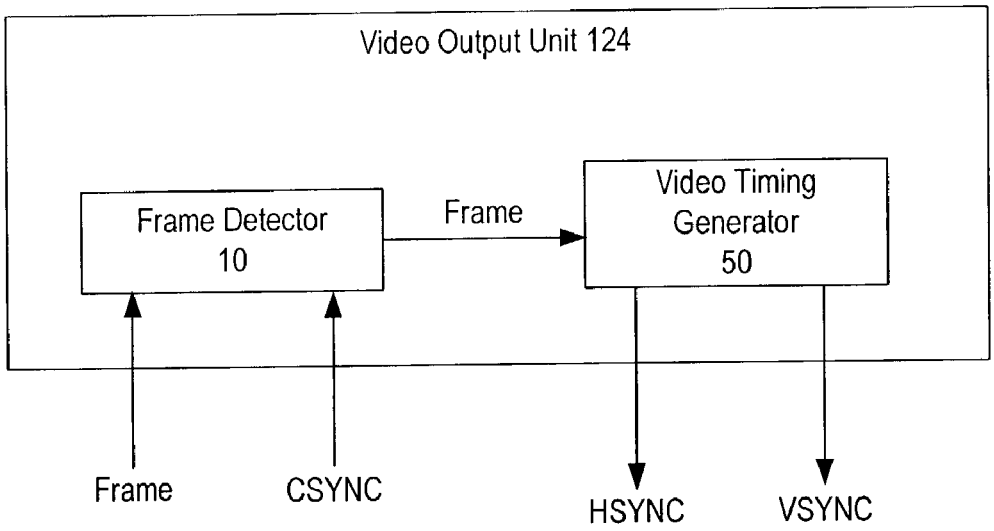
FIG. 4 shows one embodiment of a video output unit.

In order to detect the beginning of each frame of the master channel's signal, each slave display channel may include a frame detector that receives one or more synchronization signals from the master display channel. FIG. 4 shows one embodiment of a video output unit 124 that includes a VTG 50 and a frame detector 10. The frame detector 10 is configured to receive a frame signal and/or a composite synchronization signal (CSYNC) and to generate a frame signal in response. The generated frame signal may include a pulse that is asserted for one pixel clock cycle synchronous to the master display channel's frame event (as detected in the master display channel's frame signal or CSYNC signal). The frame detector 10 provides this frame signal to the VTG 50. The frame signal (if any) input to the frame detector 10 may be a frame signal that is asserted (or deasserted) for a certain duration (e.g., a pixel clock cycle or a field) at the beginning of each frame.

The VTG is configured to adjust the times at which it outputs various synchronization signals in response to the frame detector's output so that the synchronization signals generated by the VTG 50 are synchronized to the frame signal output by the frame detector. In one embodiment, the VTG may use the timing information to issue prefetch or fetch requests for image data from the frame buffer.

Figure 5:
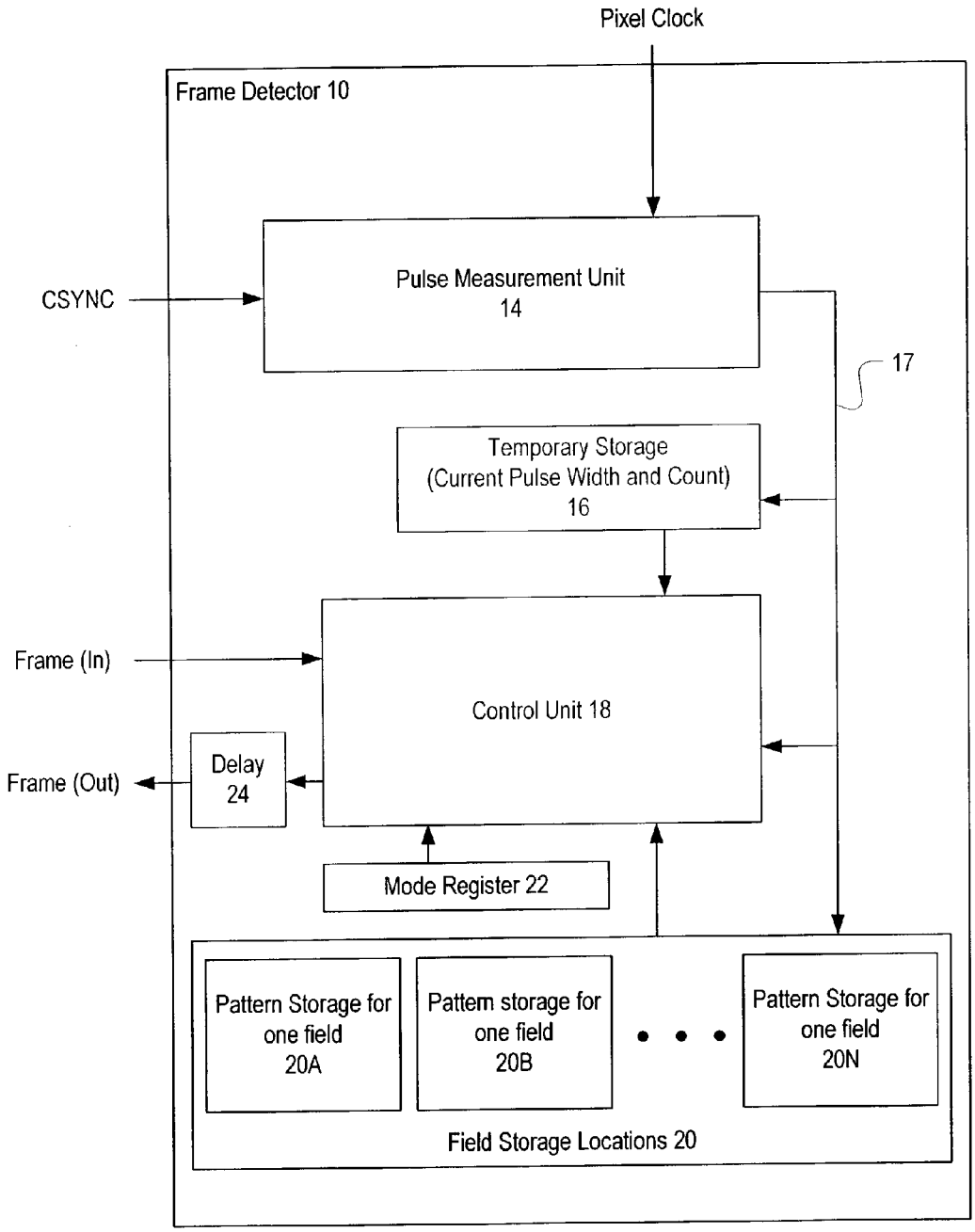
FIG. 5 shows one embodiment of a frame detector.

FIG. 5 shows one embodiment of a frame detector 10. In this embodiment, the frame detector 10 includes a pulse measurement unit 14, temporary storage 16, control unit 18, mode register 22, and pattern storage locations 20. Pattern storage 20 includes N logical storage units, each of which stores data indicative of a composite synchronization signal pulse pattern detected within one field. Accordingly, up to N different patterns may be stored in pattern storage locations 20. If there are fewer than N fields per frame, some of the patterns stored in pattern storage locations 20 may match. Each pattern includes data indicative of at least two pulse duration measurements and their associated counts, which indicate how many successive occurrences of pulses having the associated duration were detected. Each of the N logical storage units may be implemented in a separate physical storage unit in one embodiment (e.g., in separate registers). In other embodiments, the N logical storage units may be implemented in a unified physical storage device (e.g., a RAM device). In some embodiments, the same amount of storage space may be allocated to each of the N logical storage units. Alternatively, storage space may be dynamically allocated to the N storage units based on the amount of data to be stored in each.

When a frame signal is input to the frame detector 10 (and the frame detector 10 is not operating in a training mode as described below), the control unit 18 may assert (or de-assert the output frame signal in response to an edge in the input frame signal. In one embodiment, the control unit 18 may generate a frame signal that is asserted for one pixel clock cycle at the start of each frame in the master display channel. As used herein, a pixel clock is a clock used to control the rate at which pixels are output from the video output unit 124. Note that the frame signal output by the control unit 18 may have a different form than the input frame signal. For example, the input frame signal may toggle at the beginning of every field, while the output frame signal generated by control unit 18 may be asserted (or de-asserted) for one pixel clock cycle at the beginning of each field.

The frame signal generated by the control unit 18 may be passed through a programmable delay unit 24 before being output from the frame detector 10. In one embodiment, the delay of the programmable delay unit 24 may be programmed to have a value between 0 and the length of a frame. The delay may be measured in pixel clock cycles in one embodiment.

The pulse measurement unit 14 is coupled to receive a CSYNC signal. In response to a particular edge (rising or falling) in the CSYNC signal, the pulse measurement unit 14 begins measuring the duration of a pulse. For example, if the pulse measurement unit 14 includes a counter, the first edge of the pulse may enable the counter. The pulse measurement unit 14 stops measuring the duration of the pulse in response to the next edge (falling or rising) in the CSYNC signal (e.g., in embodiments that include counters, the next edge may disable the counter). The control unit 18 may be configured to generate control signals controlling which pulse(s) (high and/or low) the pulse measurement unit 14 measures within a particular CSYNC signal.

In one embodiment, the pulse measurement unit 14 may be a counter that starts and stops in response to edges in the CSYNC signal (e.g., the CSYNC signal may be input to a count enable input on the counter). The counter may be incremented in response to a clock signal. In one embodiment, the pixel clock signal may be used to clock the pulse measurement unit. If a counter is used to implement the pulse measurement unit 14, the count stored in the counter at the end of the pulse is the measurement of the pulse duration. The pulse measurement unit 14 may output data indicative of the pulse measurement on a bus 17 to be stored in temporary storage 16 and/or input to control unit 18.

In the illustrated embodiment, the accuracy of the pulse measurement made by the pulse measurement unit 14 depends on both the frequency of the clock used to clock the pulse measurement unit 14 and the accuracy of the edge indication. If the edge indication is asserted/deasserted at different points within various pulse edges and/or if the frequency of the clock is high relative to the pulse duration, pulses that actually have the same length may be measured as having slightly different lengths.

Note that in embodiments in which the pulse measurement unit 14 is clocked by the pixel clock, the pixel clock rate may change depending on the display resolution and/or the frequency of the display channel. As display resolution and/or frequency increase, the pixel clock rate may also increase. The pulse duration measurement accuracy may decrease as the pixel clock rate increases. In order to compensate for this increasing inaccuracy, high frequencies of the pixel clock may be passed through a frequency divider (e.g., another counter clocked by the pixel clock and configured to output a waveform having a period equal to N pixel clock cycles). The divided clock signal may then be used to clock the pulse measurement unit 14. The control unit 18 may generate control signals to control whether the pixel clock is divided dependent on the current frequency of the pixel clock.

Control unit 18 receives the pulse measurement made by pulse measurement unit 14. If the input to the frame detector 12 currently includes a CSYNC signal, the control unit 18 may compare the pulse measurement to a pulse measurement stored in temporary pulse/count storage 16. Given the potential inaccuracies in the pulse measurement, the control unit may be configured to perform the comparison for a range of values around the pulse measurement. For example, in one embodiment, the control unit 18 may compare the pulse measurement value in temporary pulse/count storage 16 to the new measured value and to one or more additional values computed by adding one or more compensating values to the measured value. For example, in one embodiment, the new measured value may be considered to match the value in temporary storage 16 if any value within ±2 of the new measured value equals the value stored in temporary storage 16. In other embodiments, the newly measured value may be rounded or truncated in order to compensate for inaccuracies in the pulse measurement before comparing the new pulse measurement to the current pulse measurement.

If the new pulse measurement matches the current pulse measurement stored in temporary storage 16, the control unit 18 may increment the count associated with the current pulse measurement by increasing the count value stored in temporary storage 16.

If the new pulse measurement does not match the current pulse measurement, the new pulse measurement may be stored in temporary pulse/count storage 16. In one embodiment, the temporary pulse/count storage 16 may be implemented as a register configured to store several bits of measurement and several count bits. In other embodiments, the temporary pulse/count storage 16 may be implemented in a RAM included in or coupled to the frame detector 10. In such embodiments, other data may also be stored in the RAM. Other embodiments may implement temporary pulse/count storage 16 in other memory media.

If the current pulse measurement is displaced from temporary storage 16 by the new pulse measurement, the current pulse measurement may be stored as part of the current pattern being stored in one of the N pattern storage locations 20. The control unit 18 may track which of the N pattern storage locations 20 stores the pattern that is currently being recorded. Each time a new field is detected from the CSYNC signal, the control unit 18 may begin a new pattern in a new pattern storage location 20. If the count associated with the current pulse measurement is greater than a maximum count, the control unit 18 may not store the current pulse measurement and its associated count within the current pattern storage locations 20. Instead, the control unit 18 may determine that the current pattern is complete and select a new pattern storage location 20 in which to store the next pattern.

The current pattern storage location 20 stores a pattern (pulse duration and count data) for a field currently being detected within the CSYNC signal. Each different pulse duration and its associated count detected within the current field may be stored in order within the current pattern storage location (e.g., later-detected pulse duration and count data may be stored at higher addresses than earlier-detected pulse duration and count data). Alternatively, data indicating the order in which an associated pulse duration and count were recorded (e.g., 0, 1, 2, . . . ) relative to the other pulse duration and counts stored in that pattern storage location may be included with the data representing each pulse duration and count.

As mentioned above, by detecting the occurrence of more than a maximum count of pulses having the same pulse duration, the control unit 18 may differentiate between successive fields and/or frames. Typically, each field in a frame includes active video. The length of active video is relatively long in comparison to the other portions of each field. However, the length of active video may vary greatly between different display resolutions, frequencies, and formats. In most CSYNC signals, active video is encoded as successive pulses having the same pulse length. Since active video is typically much longer than any other portion of a field, the control unit 18 may detect active video in a CSYNC signal when more than a maximum number of successive pulses having matching pulse measurements are detected. The control unit 18 may be configured to differentiate between fields by detecting active video within the current field and then monitoring the CSYNC signal for the first pulse that has a different pulse duration than the pulse duration detected during the active video period. The first different pulse identifies the first pulse in the next field.

The mode register 22 may allow the maximum count to be adjusted so that different lengths of active video may be detected. For example, in certain high resolution displays, the length of the vertical back porch may exceed the length of active video in lower resolution displays. To avoid accidentally identifying the vertical back porch as active video when receiving a CSYNC signal for a high resolution display, the maximum count for the high resolution display may be set higher than number of pulses expected during the vertical back porch. However, if this value is greater than the number of pulses expected during active video in the lower resolution display, using this value to identify active video for the lower resolution display could cause the control unit 18 to never detect active video when receiving a CSYNC signal for the lower resolution display. Accordingly, a different maximum count may be used when receiving CSYNC for the lower resolution display than when receiving CSYNC for the higher resolution display.

The maximum count may be set by setting one or more bits in the mode register 22. For example, the frame detector 10 may support high, medium, and low resolution displays and have different maximum counts associated with each type of display. The mode register setting may select which resolution's maximum count to use with a particular CSYNC signal. The mode register setting may alternatively be the maximum count itself in some embodiments (i.e., instead of selecting one of several preprogrammed maximum count values, the actual maximum count value itself may be programmable).

Thus, depending on whether the current count stored in temporary storage 16 exceeds the current maximum count value, the control unit 18 may determine whether active video is being detected. If active video is not being detected, the current pulse measurement and count may be copied into one of the pattern storage locations 20 when a new (i.e., non-matching) pulse measurement is received. In one embodiment, the control unit 18 may cycle through the pattern storage locations 20 in a repeatable order (e.g., from pattern storage location 20A to pattern storage location 20B and so on, returning to pattern storage location 20A after using pattern storage location 20N) as new fields are detected. Thus, if pulse measurements are being stored in pattern storage location 20B and the current pulse measurement and count indicates that the CSYNC signal is in an active video period, the control unit 18 may determine that the next new pulse measurement should be stored in pattern storage location 20C and discard the current pulse measurement and count. Note that in some embodiments, there may be a maximum number of pulse measurements (e.g., six different pulse measurements) that may be stored in any given pattern storage location 20.

Each field storage location 20 may include storage for at least two or more pulse measurements and their associated counts. The counts may have values greater than or equal to one.

The control unit 18 may compare data in each of the pattern storage locations 20 in order to determine which pattern storage location 20 is storing data for the first field in a frame. Note that for some CSYNC signals, more than one pattern storage location 20 may store data for the first field in a frame. For example, if there are six field storage units and three fields per frame, two of the pattern storage locations may store data for the first field in a frame. Note that, as before, there may be inaccuracies in the measurements generated by the pulse measurement unit, and thus the control unit may be configured to compare ranges of pulse measurement values (e.g., a pulse measurement ±2) when comparing data in the pattern storage locations to each other. Two or more pattern storage locations 20 store matching data if the pulse duration measurements stored in each pattern storage location match and are recorded in the same order and if the counts associated with each pulse measurement are equal.

Based on which pattern storage locations have matching data, the control unit 18 may determine which fields storage location(s) store data for the first field in a frame. For example, if all of the pattern storage locations have matching data, the control unit 18 may determine that there is one field per frame. Similarly, if two out of every three field storage locations contain matching data, the control unit 18 may determine that there are three fields per frame. The pattern storage location that stores data for the one field per frame that differs from the other two fields may be identified as storing data representing the first field in the frame.

Each time the control unit 18 detects a pattern in the CSYNC signal that matches the pattern stored in the pattern storage location identified as storing data for the first field in a frame, the control unit 18 may toggle the frame signal to a new value. In one embodiment, the control unit 18 may toggle the frame signal again one pixel clock cycle later. For example, if the frame signal is an active high frame signal, the control unit 18 may assert the frame signal for one pixel clock cycle each time the beginning of a frame is detected within the CSYNC signal.

Because the control unit 18 may not detect that a set of pulse measurements and counts generated in response to the CSYNC signal matches those stored in the pattern storage location storing data for the first field in a frame until after the initial pulse within that field, the frame signal generated by the control unit 18 may be delayed with respect to the frame signal encoded within the CSYNC signal. In order to output the frame signal at the proper time (e.g., synchronized to the CSYNC signal or delayed by a user-programmed amount of delay from the CSYNC signal), the control unit 18 may control the delay of the delay unit 24. The control unit 18 may use the pulse width measurements and their associated counts stored in the pattern storage location storing data for the first field in a frame to determine when the control unit 18 generated the frame signal relative to the start of that field. The control unit 18 may then subtract this amount of time from the total length of the frame in order to determine the amount of delay. A user-specified delay, if any, may then be added to that amount of delay. The control unit 18 may program the delay unit 24 to delay the frame signal such that the start of frame indication generated in response to the beginning of frame N is delayed until the beginning of frame N+1 (or until a user-specified delay after the beginning of frame N+1).

Note that the same delay unit 24 used to delay a frame signal generated in response to a received CSYNC signal may also be used to delay a frame signal generated in response to a received frame signal. Thus, in embodiments where the frame detector is configured to receive both CSYNC and frame signals, the amount of delay circuitry needed to add a user-specified delay to a frame signal detected in either type of input signal may be reduced. Note that in alternative embodiments, however, the frame detector may only be configured to receive a CSYNC signal.

Figure 6:
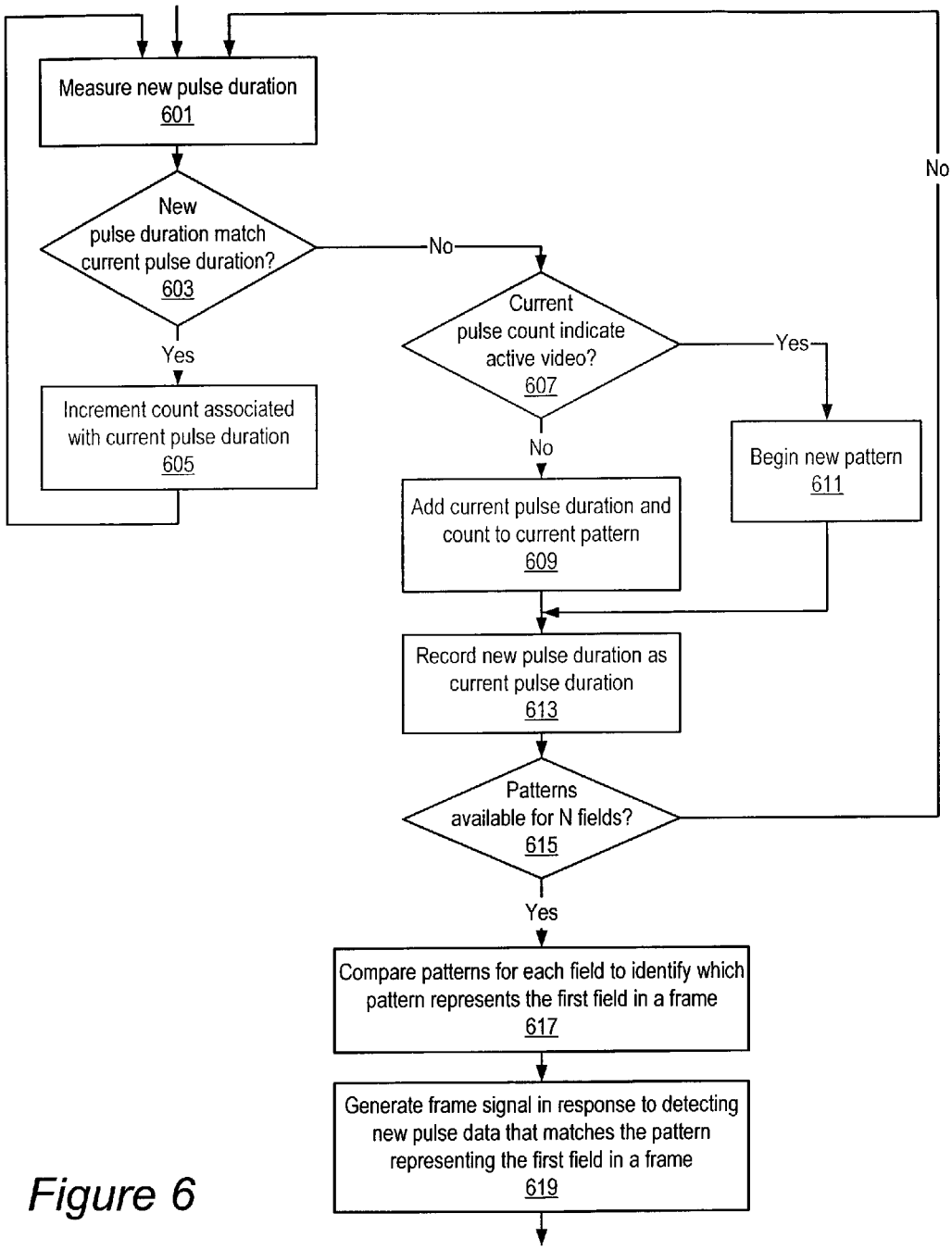
FIG. 6 is a flowchart of one embodiment of a method of detecting a frame within a composite synchronization signal.

FIG. 6 illustrates one embodiment of a method of detecting a frame signal within a composite synchronization signal. At 601, a new pulse duration is measured for a pulse (either positive or negative) detected within a CSYNC signal. If the new pulse duration matches the current pulse duration, the count associated with the current pulse duration may be incremented, as shown at 603–605. If the new pulse duration does not match the current pulse duration, the new pulse duration may be recorded as the current pulse duration, as shown at 603 and 613. If the current pulse count does not indicate that an active video period is being detected (e.g., the current pulse count is less than a maximum pulse count), the current pulse count may be added to the current pattern that is being recorded, as indicated at 607–609. The current pattern may store several pulse duration measurements and the counts associated with each pulse duration measurement. If the current pulse count indicates that an active video period is being detected, a new pattern may be started (i.e., active video may signal the end of the current pattern). Additionally, the current pulse duration and count may be discarded if the current count is indicative of active video.

If patterns are available for at least N fields, the patterns may be compared to determine which patterns identify the first field in a frame, as indicated at 615 and 617. Note that in some embodiments, the patterns may be compared before patterns have been recorded for at least N fields. The patterns may be compared to determine which patterns, if any, match (i.e., include matching pulse durations that have the same counts and were detected in the same order). The ratio of matching patterns to non-matching patterns may indicate how many fields there are in a frame. For example, if two out of three patterns match, there may be three fields per frame. The non-matching pattern(s) may be identified as pattern(s) identifying the first field in a frame.

At 619, a frame signal may be toggled in response to detection of a new pattern (pulse duration measurements and counts) that matches the pattern identified as identifying the first field in a frame. The frame signal may be delayed before being output to a receiving device in some embodiments.

Frame Detector Training Mode

In some embodiments, a frame detector 10 such as the one illustrated in FIG. 5 may be operable in several modes (e.g., a normal mode and a training mode). Different modes may be selected by setting one or more bits in the mode register 22 to specific values indicative of a desired frame detector mode. One mode may be a training mode. In this mode, the frame detector 10 may be supplied with both a CSYNC signal and the frame signal that is encoded in that CSYNC signal. These signals may be generated by the internal VTG 50 coupled to the frame detector 10 in some embodiments. The signals may be generated based on the expected behavior of a CSYNC signal (e.g., received from an external VTG) that will later be input to the frame detector 10 so that the internal VTG 50 can be synchronized to the external VTG. For example, if the external CSYNC signal is expected to be a field-sequential color CSYNC signal for a display having a particular frequency and resolution, the internal VTG may generate the timing signals appropriate for that CSYNC encoding at that display resolution and frequency.

In response to the CSYNC signal, the frame detector 10 may record patterns (i.e., several pulse measurements and their associated counts) for up to N fields, as described above. However, instead of comparing the patterns stored in the pattern storage locations to each other, the frame detector 10 may use the received frame signal to determine which field storage location is storing data for the first field in a frame. For example, each time the frame signal toggles, the control unit 18 may identify the pattern currently being recorded as the pattern representing the first field in a frame.

While in training mode, the frame detector 10 may not output a frame signal. Instead, the frame detector 10 may record patterns for up to N fields by storing patterns for each field in a respective pattern storage location 20. The frame detector 10 may also use the received frame signal to identify which pattern represents the first field in a frame.

Once the frame detector has identified the pattern representing the first field in the frame for a particular CSYNC signal, the frame detector 10 is considered to be trained for that CSYNC signal. In some embodiments, the frame detector 10 may not be considered trained until the data stored in the pattern storage locations 20 has stabilized (e.g., until the patterns in each of the pattern storage locations 20 are not modified in response to subsequent fields detected within the CSYNC signal).

The host computer system may cause the frame detector 10 to exit training mode (e.g., by modifying a mode setting in a mode register 22) once the frame detector 10 is trained. An externally generated CSYNC signal may then be provided to the trained frame detector 10. Based on the data already stored within the pattern storage locations 20 during training mode, the frame detector 10 may begin generating a frame signal in response to detecting occurrences of the first field within a frame within the externally generated CSYNC signal.

Figure 7:
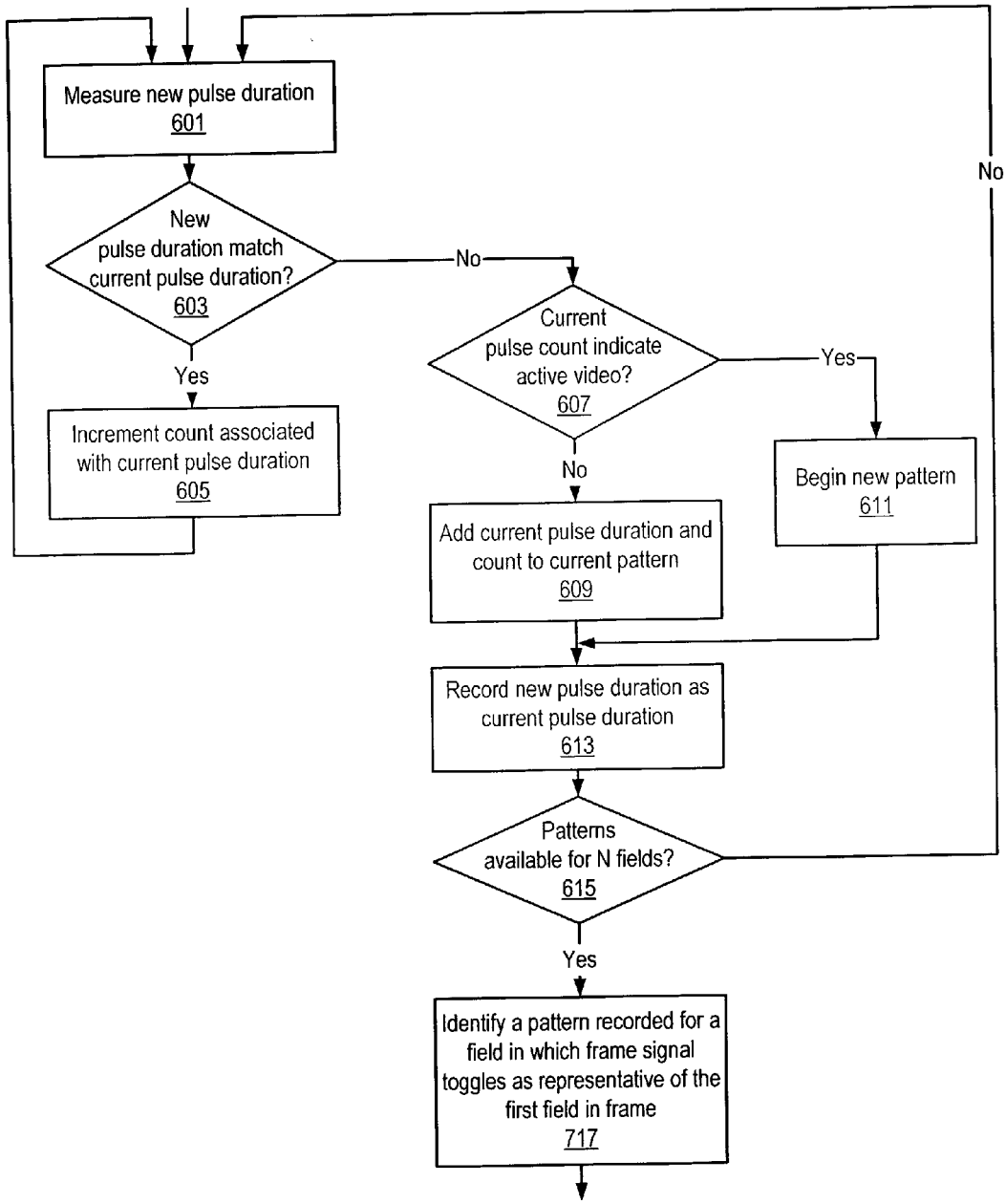
FIG. 7 is a flowchart of one embodiment of a method of training a frame detector for use with a particular composite synchronization signal.

FIG. 7 illustrates one embodiment of a method of operating a frame detector during training mode. Functions performed within this method that are similar to those performed within the method of FIG. 6 are numbered similarly (e.g., function 601 in FIG. 6 is similar to function 601 in FIG. 7). This method operates by recording patterns as described above with respect to FIG. 6. However, instead of comparing the recorded patterns to each other, this method involves identifying a pattern recorded for a field in which the frame signal toggles as the pattern representing the first field in the frame, as shown at 717. Note that in some embodiments, this function 717 may be performed before patterns for N fields have been recorded.

Numerous variations and modifications will become apparent to those skilled in the art once the above disclosure is fully appreciated. It is intended that the following claims be interpreted to embrace all such variations and modifications. Note the section headings used herein are for organizational purposes only and are not meant to limit the description provided herein or the claims attached hereto.

What is claimed is:

1. A frame detector configured to operate in a plurality of frame detection modes, the frame detector comprising:

a measurement unit configured to generate data indicative of a duration of each of a plurality of pulses included in a composite synchronization signal;

a counter configured to generate data indicative of a number of successive occurrences of pulses having a same duration;

a memory coupled to the measurement unit and the counter and configured to store pattern data detected during each of a plurality of fields, wherein the pattern data for each field includes data indicative of two or more pulse durations generated by the measurement unit, wherein the pattern data for each field further includes data indicative of two or more counts generated by the counter, wherein each count is associated with a respective one of the two or more pulse durations;

a control unit coupled to the memory and configured to perform a comparison of the pattern data stored during each of the plurality of fields and to identify which pattern data identifies a first field in a frame dependent on the comparison; and a mode register coupled to the control unit;

wherein storing one value of a plurality of values in the mode register determines a corresponding mode of operation of the frame detector, and wherein one of the corresponding modes is a training mode in which the frame detector is supplied with the composite synchronization signal and a frame signal corresponding to the frame signal encoded in the composite synchronization signal.

2. The frame detector of claim 1, wherein the measurement unit includes a measurement unit counter configured to begin incrementing in response to detection of an edge in the composite synchronization signal and to continue incrementing until detection of a next edge in the composite synchronization signal, wherein the measurement unit counter is configured to increment in response to a pixel clock.

3. The frame detector of claim 2, wherein the measurement unit counter is configured to begin incrementing in response to detection of a falling edge in the composite synchronization signal and to continue incrementing until detection of a rising edge in the composite synchronization signal.

4. The frame detector of claim 2, wherein the counter is configured to increment if a new pulse duration measured by the measurement unit counter for a new pulse matches a current pulse duration measured by the measurement unit counter for a current pulse, wherein the new pulse is a next successive pulse after the current pulse.

5. The frame detector of claim 4, wherein the new pulse duration matches the current pulse duration if the new pulse duration equals the current pulse duration plus or minus a constant integer.

6. The frame detector of claim 1, wherein the memory is configured to store pattern data for at least six fields.

7. The frame detector of claim 1, wherein the control unit is configured to generate a frame signal in response to the composite synchronization signal, wherein the control unit is configured to toggle the frame signal in response to detecting the pattern data identifying the first field in a frame from the composite synchronization signal.

8. The frame detector of claim 1, wherein when the frame detector is operating in training mode, the control unit is configured to receive a frame signal and to identify which pattern data identifies the first field in the frame by identifying which pattern data is currently being generated from the composite synchronization signal when the frame signal toggles.

9. The frame detector of claim 1, further comprising a delay unit, wherein the delay unit is configured to delay a frame signal generated by the control unit.

10. The frame detector of claim 1, further comprising a video timing generator coupled to the frame detector, wherein the composite synchronization signal and the frame signal that is encoded in the composite synchronization signal are generated in the video timing generator and sent to the frame detector.

11. The frame detector of claim 1, wherein the frame detector records a plurality of patterns of pulse measurements and corresponding counts in the composite synchronization signal, and uses the corresponding frame signal to identify and store the particular one of the plurality of patterns that corresponds to a first field in a frame.

12. The frame detector of claim 11, wherein the frame detector is supplied with a plurality of different composite synchronization signals and corresponding frame signals, and the frame detector identifies and stores a pattern that corresponds to a first field in a frame for each composite synchronization signal.

13. A method for operating a multi-mode frame detector, the method comprising:

storing data indicative of a pulse duration and data indicative of a number of successive occurrences of pulses having the pulse duration, for each of a plurality of different pulse durations detected in a field of a composite synchronization signal;

repeating said storing for one or more other fields of the composite synchronization signal;

receiving a frame signal if in a training mode and identifying which field's data corresponds to an occurrence in the frame signal of a first field in a frame in response to said receiving the frame signal, wherein the frame signal corresponds to a frame signal encoded in the composite synchronization signal;

comparing data stored for each of the fields of the composite synchronization signal if not in a training mode; and generating and outputting a frame signal dependent on an outcome of said comparing if not in a training mode.

14. The method of claim 13, further comprising generating the data indicative of the pulse duration by enabling a pulse measurement counter in response to detection of an edge in the composite synchronization signal and stopping the pulse measurement counter in response to detection of a next edge in the composite synchronization signal, wherein the pulse measurement counter is configured to increment in response to a pixel clock.

15. The method of claim 14, wherein the edge is a falling edge and where the next edge is a rising edge.

16. The method claim 13, further comprising generating the data indicative of the number of successive occurrences of pulses having the pulse duration by incrementing a count associated with the pulse duration each time a successive pulse having a new duration matching the pulse duration is detected.

17. The method of claim 16, wherein the new duration matches the pulse duration if the new duration equals the pulse duration plus or minus a constant integer.

18. The method of claim 13, wherein said repeating comprises repeating said storing for at least six fields.

19. The method of claim 13, further comprising identifying which field's data represents a first field in a frame in response to said comparing.

20. The method of claim 13, further comprising delaying outputting the frame signal.

21. A method for operating a multi-mode frame detector, the method comprising:

storing data indicative of a plurality of patterns, wherein each pattern is detected during one of a plurality of fields within a composite synchronization signal received by the frame detector, wherein each pattern includes at least two pulse measurements and at least two counts, wherein each count indicates a number of successive occurrences of pulses having a respective one of the at least two pulse measurements;

during a training mode, detecting an edge in a frame signal received by the frame detector during one of the plurality of fields and responsively identifying one of the patterns as indicative of a first field in a frame, wherein the frame signal corresponds to a frame signal encoded in the composite synchronization signal; and during a non-training mode, toggling a frame signal output from the frame detector in response to detecting a pattern matching the one of the patterns identified as indicative of the first field in the frame.

22. The method of claim 21, further comprising generating a pattern for one of the plurality of fields by:

measuring a new pulse duration of a new pulse detected within the composite synchronization signal;

incrementing a count associated with a current pulse duration if the new pulse duration matches the current pulse duration;

if the new pulse duration does not match the current pulse duration, storing the current pulse duration and the count as part of the pattern and recording the new pulse duration as the current pulse duration; and repeating said measuring, incrementing and storing for one or more pulses subsequently detected within the composite synchronization signal.

23. The method of claim 22, wherein said measuring the new pulse duration comprises enabling a counter in response to a first edge of the new pulse and stopping the counter in response to a second edge of the new pulse, wherein the counter is configured to increment in response to a pixel clock.

24. The method of claim 23, wherein the first edge is a falling edge in the composite synchronization signal and the second edge is a rising edge in the composite synchronization signal.

25. The method of claim 22, wherein the new pulse duration matches the current pulse duration if the new pulse duration equals the current pulse duration plus or minus a constant integer.

26. The method of claim 21, wherein said plurality of patterns comprises at least six patterns.

27. The method of claim 21, further comprising delaying the frame signal.

28. The method of claim 21, wherein the composite synchronization signal and the frame signal are generated in a video timing generator coupled to the frame detector.

29. The method of claim 21, wherein the frame detector during a training mode is supplied with a plurality of different composite synchronization signals and corresponding frame signals, and the frame detector identifies and stores a pattern that corresponds to a first field in a frame for each composite synchronization signal.

30. The method of claim 21, wherein the frame detector during a training mode does not output a frame signal.

* * * * *